US007997564B2

(12) United States Patent
Wu

(10) Patent No.: US 7,997,564 B2
(45) Date of Patent: Aug. 16, 2011

(54) COMBINED WATERWHEEL OXYGEN-INCREASING MACHINE

(76) Inventor: Weiguo Wu, Zhejiang (CN)

( * ) Notice: Subject to any disclaimer, the term of this patent is extended or adjusted under 35 U.S.C. 154(b) by 888 days.

(21) Appl. No.: 11/969,420

(22) Filed: Jan. 4, 2008

(65) Prior Publication Data

US 2008/0164624 A1 Jul. 10, 2008

(30) Foreign Application Priority Data

Jan. 8, 2007 (CN) ..... 2007 1 0004603
Jul. 17, 2007 (CN) ..... 2007 1 0137759

(51) Int. Cl.
*B01F 3/04* (2006.01)

(52) U.S. Cl. ..... 261/92; 210/242.2

(58) Field of Classification Search ..... 261/91, 261/92, 120; 210/242.2
See application file for complete search history.

(56) References Cited

U.S. PATENT DOCUMENTS 5,116,501 A * 5/1992 House ..... 210/242.2
* cited by examiner

*Primary Examiner* — Robert A Hopkins
(74) *Attorney, Agent, or Firm* — Global IP Services; Tianhua Gu

(57) ABSTRACT

The combined waterwheel oxygen-increasing machine pertains to the area of life-saving and facilitation equipment in aquaculture development. The existing waterwheel oxygen-increasing machine is a floating body with brackets integrally connected, inconvenient for assembly and disassembly and for general use. The present invention comprises of floating bodies, a power device, a reduction gearbox and impellers, wherein the power device is connected to a reduction gearbox, which then drives said impellers via an output shaft. The floating bodies are hollow, closed, bodies including longitudinal floating bodies and transversal floating body connected vertically with each other, wherein one end of the longitudinal floating bodies are connected to transversal floating body. The floating bodies bear an output shaft. The impellers are located in the midst of the area surrounded by the longitudinal floating bodies and the transversal floating body. Moreover, said impellers are overlapping impellers connected in a series by a plurality of single impeller bodies.

18 Claims, 15 Drawing Sheets

COMBINED WATERWHEEL OXYGEN-INCREASING MACHINE

CROSS REFERENCE TO RELATED PATENT APPLICATION

This application claims the priorities of the Chinese patent applications No. 200710004603.9 with a filing date of Jan. 8, 2007 and No. 200710137759.4 with a filing date of Jul. 17, 2007.

FIELD OF THE INVENTION

The present invention relates to an oxygen-increasing machine, in particular, to a combined waterwheel oxygen-increasing machine.

BACKGROUND OF THE INVENTION

The oxygen-increasing machine is the life-saving and facilitation equipment for fish and shrimp. Existing mechanical oxygen-increasing machines mainly include three types, that is, the waterwheel type, impeller type and water-spraying type. The waterwheel type is used in more fields. The existing waterwheel oxygen-increasing machine adopts the arrangement that an integral bracket is connected to the floating bodies, and the power devices such as the engine, reduction gearbox, etc., are installed on the integral bracket, which leads to inconvenient assembly and disassembly. For instance, the U.S. Pat. No. 6,634,626B2 and U.S. Pat. No. 5,116,501A are inventions that adopt the solution of integral bracket being connected to floating bodies, which must use stainless steel to manufacture the machine for the purpose of preventing corrosion by seawater. Therefore, the machine is heavy in weight, which affects the buoyancy of the floating bodies and is expensive in price. Moreover, the power and volume of existing waterwheel oxygen-increasing machines are not adjustable. Impellers are an integral structure with a fixed number of blades and nonadjustable lengths of axial direction of impellers. It has many disadvantages such as a complicated manufacturing process, high cost, narrow applicable scope and bad general usage properties.

SUMMARY OF THE INVENTION

The present invention aims to solve technical problems and bring forward technical tasks by overcoming defects in the existing waterwheel oxygen-increasing machine, provide a combined waterwheel oxygen-increasing machine with an improved structure, provide a free adjustable number of floating bodies in accordance with power and a selected flexible assembly mode.

Furthermore, the present invention aims to provide an oxygen-increasing machine with an adjustable length of axial direction of impellers and adjustable number of blades in terms of actual power, thus to advance the applicable scope and general usage property of the oxygen-increasing machine.

The technical solution for the present invention is:

A combined waterwheel oxygen-increasing machine, comprising of a combined floating body, a power device, a reduction gearbox and impellers, the power device is connected to the reduction gearbox for driving the impellers via an output shaft, the combined floating body including a transversal floating body assembled by one transversal segment floating body at least and longitudinal floating bodies, which is connected vertically with the longitudinal floating bodies, one end of each longitudinal floating body is connected to the transversal floating body; the part of the combined floating body for bear output shaft, and impellers are surrounded by the longitudinal floating bodies and the transversal floating body.

Floating bodies are hollow and closed bodies made of plastic materials via blow molding at one time, wherein the closed body is used to store air in order to produce buoyancy. Longitudinal floating bodies and transversal floating body set by separated bodies can combine freely in accordance with actual use, wherein the vertical connection is of great advantage for floating bodies to keep balance in water and for impellers borne by floating bodies to float steadily on the water's surface. Thus, to achieve oxygen-increasing by agitating water flow in the work state, the power device is generally an engine and can be a device offering power for internal-combustion engines, etc., under special situations.

As further improvement and supplement to the technical solution mentioned above, the present invention further includes the following additional technical characteristics:

The longitudinal floating body is vertically connected to the center part of the transversal floating body to form a "T" shaped of the combined floating bodies. The power device and reduction gearbox are set on the longitudinal floating body. The impellers are installed on an output shaft and symmetrically arranged on both sides of the longitudinal floating body. One longitudinal floating body is connected with one transversal floating body and impellers are symmetrically set on both sides of longitudinal floating body only; therefore, the water area permitting stir is small in size. Said "T" type structure of the combined floating body is applicable to oxygen-increasing machines with low power demand.

The two ends and middle part of said transversal floating body are connected by the parallel longitudinal floating bodies with same side to the transversal body to form an "E" shaped combined floating body. The power device is installed on the longitudinal floating body in the middle. The output shaft includes a drive shaft of the reduction gearbox and a propeller shaft connected with the drive shaft. The impellers are set on to the propeller shaft. Said "E" shaped combined floating body is another structure of oxygen-increasing machine with low power. Upon the connection of longitudinal and transversal floating bodies, impellers are arranged symmetrically on both sides of power device.

Plural longitudinal floating bodies are connected with the transversal floating body in balance to form comb-tooth shaped floating bodies. The output shaft includes a drive shaft of reduction gearbox and a propeller shaft connected with the drive shaft and said impellers are set on the propeller shaft. As to the oxygen-increasing machine with a higher power, a plural number of longitudinal floating bodies vertically connected with transversal body which includes plural transversal segment floating bodies in order to increasing the length of, thus helping to connect more impellers.

Said impellers are set between the longitudinal floating bodies which include main longitudinal floating bodies and auxiliary longitudinal floating bodies; the power device and reduction gearbox are set on one side of the floating bodies, the drive shaft of reduction gearbox drives the propeller shaft through a universal drive joint. The impellers are set on the propeller shaft, which is borne on a bearing seat. This position arrangement makes the power device and reduction gearbox locating on the coast of water area beside the combined floating bodies, so as to drive the reduction gearbox by using an internal-combustion engine, which is very applicable to the areas without electric power supply.

The impellers are set between longitudinal floating bodies that include main longitudinal floating bodies and auxiliary longitudinal floating bodies, wherein the main longitudinal floating body is equipped with the power device, the auxiliary longitudinal floating bodies are equipped with a bearing seat and the propeller shaft is borne on the bearing seats. The main longitudinal floating bodies featuring large buoyancy are used to hold a heavy power device and reduction gearbox. One end of the propeller shaft is connected to the reduction gearbox set on to the main longitudinal floating bodies (connected through a shaft coupler with the drive shaft of reduction gearbox), and the other end is set on to auxiliary longitudinal floating bodies by bearing seats. This makes the output shaft equalize the weight of load impellers to prevent an output shaft from bending and deforming; the auxiliary longitudinal floating bodies are symmetrically set on both sides of the power device, allowing the whole combined floating bodies to keep balance. The water-entry depth of impellers must remain consistent. The arrangement modes can be so that both sides of the main longitudinal floating body installed power device are entirely set auxiliary longitudinal floating bodies; or the main longitudinal floating bodies and auxiliary longitudinal floating bodies alternately spaced, where the interval number is determined by the actual demand; or other practicable arrangement modes in favor of keeping the combined floating bodies balanced. The free combination constitutes the oxygen-increasing machine with varying power.

A connection rod parallel to the transversal floating body is set on to the free end of the longitudinal floating bodies. A flange with a through-hole is set on to the side part of the longitudinal floating bodies and a fastener passing the through-hole fixes a mounting bracket on to the floating bodies. The connection rod set here is capable of enhancing the integrity and stability of the combined floating bodies, helping to keep balance. The mounting bracket is used to fix components such as the power device, reduction gearbox and bearing seat, etc., on the combined floating bodies.

The present invention is also provided with an improved solution to the impellers:

The impellers are overlapping impellers, composed of a plurality of single impeller bodies connected in a series, the single impeller body composed of an impeller seat and blades connected on the seat, a link mechanism connecting neighboring single impeller bodies is set on the impeller seat. A plurality of single impeller bodies are connected in a series of impellers of combined structure by the link mechanism on the impeller seat. Therefore, by increasing or decreasing the number of single impeller bodies connected in the series, the length of axial direction of impellers can be adjusted and the number of blades can be altered, thus meeting the power demand in actual use, featuring a fine general usage property and a wider application scope.

The link mechanism is a connection seat distributed on the wheel edge of impeller seat, a connection rod is set on to one end of the connection seat and a connection hole is on the other end. The connection rod and the connection hole on the neighboring single impeller bodies are plugged and fitted by each other. This realizes a plurality of single impeller bodies connecting in a series and making the assembly and disassembly of single impeller bodies easier.

The impeller seat can adopt the following structure: the impeller seat is comprised of a main impeller seat and auxiliary impeller seat.

The main impeller seat is provided with a boss-shaped shaft hole and a bearing bar is connected between said shaft hole and the wheel edge. The main impeller seat and the auxiliary impeller seat are connected in series mutually. The shaft hole is boss-shaped with a certain thickness, capable of increasing the connecting area between the propeller shaft and the shaft hole, so as to ensure a more reliable transference of drive force, thus to prevent impellers from excessively swaying while in operation. A bearing bar can enhance the bearing intensity of the wheel edge. Furthermore, the main impeller seat, connected with blades, can be used as an independent impeller. The auxiliary impeller seat is usually used in combination with the main impeller seat, but a plurality of auxiliary impeller seats connected in series and covered by an end cover with a shaft hole on both side-ends can be used solely.

Wherein the connection column and connection hole are imbalanced: the boss-shaped shaft hole is reinforced by an outer-sleeve. Its outer edge has a recess with a radial-directed through-hole, in which a nut is pre-embedded. The nut is connected with a bolt. Since the connection column and connection hole are mutually imbalanced, upon a plurality of singly impeller bodies connecting in a series; connection seats set on adjoined impellers appear to be in a spiral distribution. So, the integrally stressed pressure, while impellers in operation are more uniform, propeller shaft and shaft hole are connected tightly in combination with the bolt connected bolt and pre-embedded nut, of the reinforcing sleeve outside of the shaft hole is used to enhance the intensity of the shaft hole and reliability of the connection between the propeller shaft and shaft hole. In the case that the components such as impeller bodies, impeller seats, etc., are made of plastic materials, the reinforcing sleeve can be a metallic sleeve made by a stretched stainless steel plate, which will achieve a better application effect.

The connection seat can be a hollow seat, located on the outer side of the wheel edge, on which sets a radial-directed plug seat slotted with a location notch. On the connection end of said blade sets an elastic fixing block. The said connection end is plugged into the plug seat and the elastic fixing block is clamp-connected in the location notch. While in use, the blade is inserted into the plug seat and then the blade is installed securely onto the wheel edge by using the mutual combination of the elastic fixing block and location notch on the plug seat. Moreover, the plug seat can be directly set onto the wheel edge, being the same function of that on the connection seat.

The impeller seat also can be designed into the structure like this: impeller seats appear to be hollow-shaped. Upon the plural number of impeller seats connected in series, at least one end cover with a shaft hole is set on the side-end. The hollow impeller seats are characterized by a simple structure, materials saving and convenience in making. By making use of the connection of end cover on side-end and propeller shaft, driving force is transferred orderly into various impeller seats connected in a series to drive the impellers' rotation. Upon the connection of a plural number of impeller seats in series, the installation of end covers on both side-ends can further tighten the impeller seats in series.

The hollow connection seats can also be set on the interior side of the wheel edge. The connection column and connection hole are coaxially arranged and the end cover is connected on the connection seat by a long stud bolt. The arrangement of connection column and connection hole coaxially set is easier to make than that of imbalanced ones. Because the impeller seats are hollow structures and light in weight, upon the connection in series of a plurality of single impeller bodies, the adjoined connection seats are linearly coaxial, making the impellers work in a stable way.

For the present invention, the blades and connection seats of the impellers are evenly distributed on impeller seats. The joint angle between the two neighboring blades is bigger than the joint angle between two neighboring connection seats; at least one blade and a connection seat shall be set in disarrangements. This kind of arrangement can ensure that the neighboring single impeller bodies are connected in disarrangements for the purpose of forming a series connected impellers, the blades distributed along an axial direction on impellers appear to be in a spiral layout. The drive force of integral transference is more uniform while impellers work, thus helping to enhance the work efficiency of impellers.

The blades of the impellers for the present invention can also be fixedly connected onto the wheel edge. For example, the blow molding at one time, makes the impellers and wheel edge become an integral structure, creating higher intensity. Besides, the connection and cooperation by the clamping piece and clamping nick can fasten blades tightly, thus making the structure simpler and the connection more reliable. The connection between the blade and wheel edge can also adopt other methods, such as nut connection, welding or gluing, etc.

The link mechanisms can be an internal thread and external thread set separately on both sides of the wheel edge. By the adaptation of threads, the series connection between single impeller bodies can be achieved.

Furthermore, a water leakage trough can be slotted in the impeller seats, for the purpose of preventing the seeper while impellers work and to save making materials. Blades can be made in various shapes, such as angular shapes, curved shapes, flat plated shapes, etc., in order to meet the oxygen-increasing demands in different situations.

The present invention, by floating bodies being divided into the transversal one and the longitudinal one, realizes the flexible combination for assembly in accordance with the actual demand for power of the oxygen-increasing machine. It omits the integral metal bracket for the existing technical solution, which is much more convenient for both assembly and disassembly. Meanwhile, it replaces the impellers with an integrative structure in the existing art with the method using a plurality of single impeller bodies connected in series to become combined overlapping impellers; and the number of series connected single impeller bodies; length of axial direction of impellers and the number of blades can be adjusted. This achieves a better general usage property and a wider application scope. The present invention also bears the advantages of lightweight and fine floating properties as well as low manufacturing costs for plastic materials being used. The application of improved floating bodies and improved impellers for the present invention realize the desired result of reasonable structure, good general use property and fine oxygen-increasing effects.

To combine the figures and the embodiments, further description for the present invention will be exhibited hereinafter:

Figure 1:
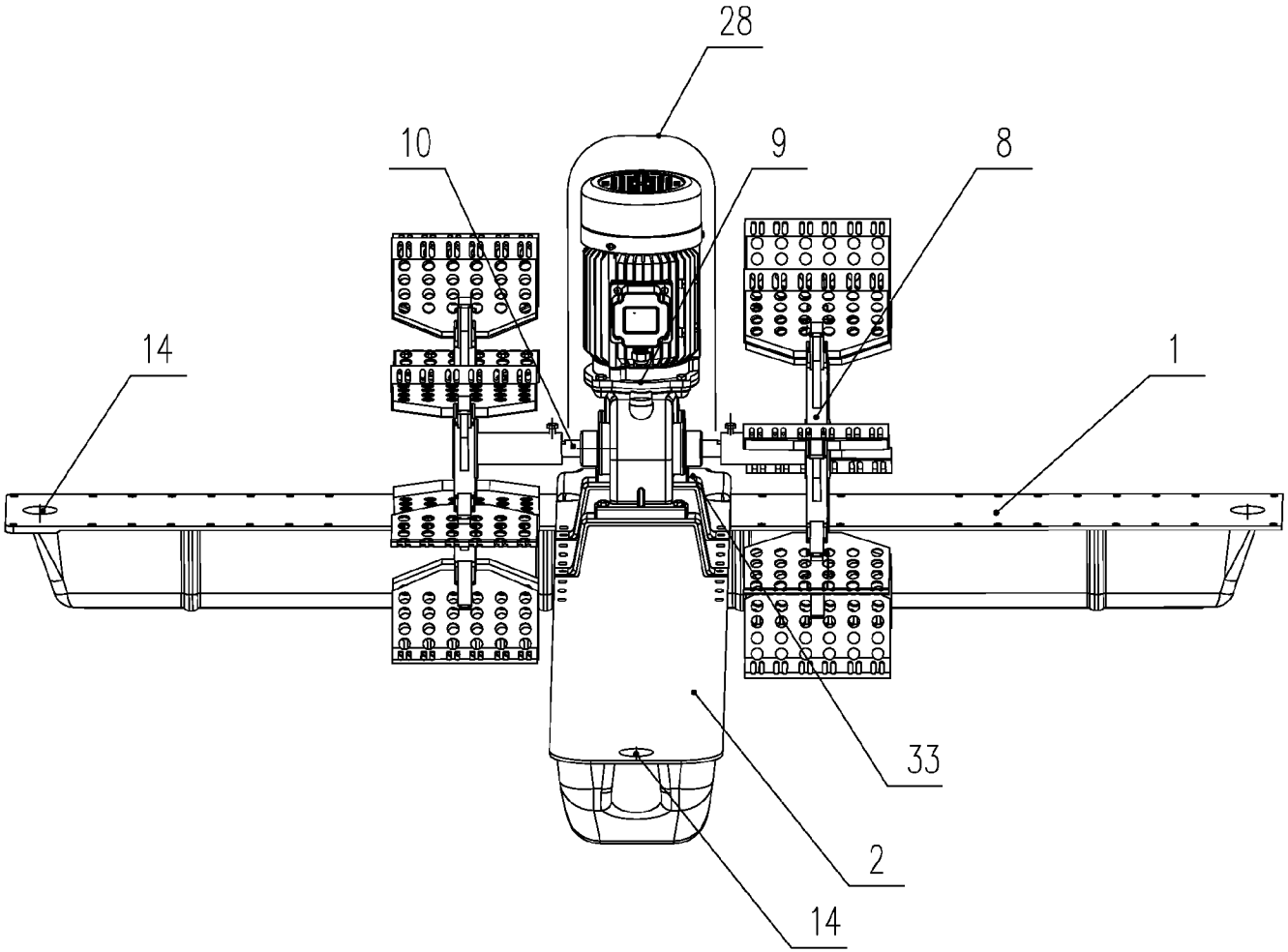
FIG. 1 is a structural schematic diagram for the combined waterwheel oxygen-increasing machine of "T" shaped floating bodies for the present invention.

In these figures: 1. transversal floating body, 2. main longitudinal floating body, 3. auxiliary longitudinal floating bodies, 4. main impeller seat, 5. auxiliary impeller seat, 6. blade, 7. single impeller body, 8. impeller, 9. power device, 10. drive shaft, 11. elastic fixing block, 12. location notch, 13. plug, 14. rod-inserting hole for floating bodies location, 15. reinforcing sleeve, 16. bolt, 17. bearing seat, 18 propeller shaft, 19. end cover, 20. combined surface, 21. universal drive joint, 22. long stud bolt, 23. connection column, 24. connection hole, 25. contact surface, 26. connection seat, 27. water-cooled engine, 28. water-poof hood, 29. shaft hole, 30. bearing bar, 31. plug seat, 32. connection rod, 33. mounting bracket.

DETAILED DESCRIPTION OF THE INVENTION

A combined waterwheel oxygen-increasing machine for the present invention comprises a combined floating body, a power device (9), a reduction gearbox and impellers (8). The combined floating body is hollow closed body including longitudinal floating bodies and transversal floating body (1) assembled by one transversal segment floating body at least. On one end of the longitudinal floating bodies sets combined surface (20) used to vertically connect with transversal floating bodies (1), a flange with through-hole is set on the longitudinal floating bodies. The mounting bracket (33) is fixed on to the floating bodies by a fastener passing through the through-hole. The power device (9) is connected to the reduction gearbox, which then drives the impellers (8) by a drive shaft (10).

Now further description will be exhibited hereinafter by combining drawings and several embodiments:

Embodiment 1, as shown in FIG. 1, is a combined water-wheel oxygen-increasing machine of "T" shaped floating bodies: a main longitudinal floating body (2) is vertically connected to the middle part of the transversal floating bodies 1 assembled by only one transversal segment floating body. Upon connection with the reduction gearbox below it, the power device (9) is uprightly connected to the longitudinal floating bodies (2) by a mounting bracket (33). The waterproof hood (28) covers the power device. The reduction gearbox drive shaft (10) is connected with impellers (8) on the right and left side. Both the end part of the transversal floating body (1) and main longitudinal floating body (2) set a rod-inserting hole for the floating bodies location (14) which is used to put a location rod for preventing the oxygen-increasing machine from moving in the water while it works.

Figure 2:
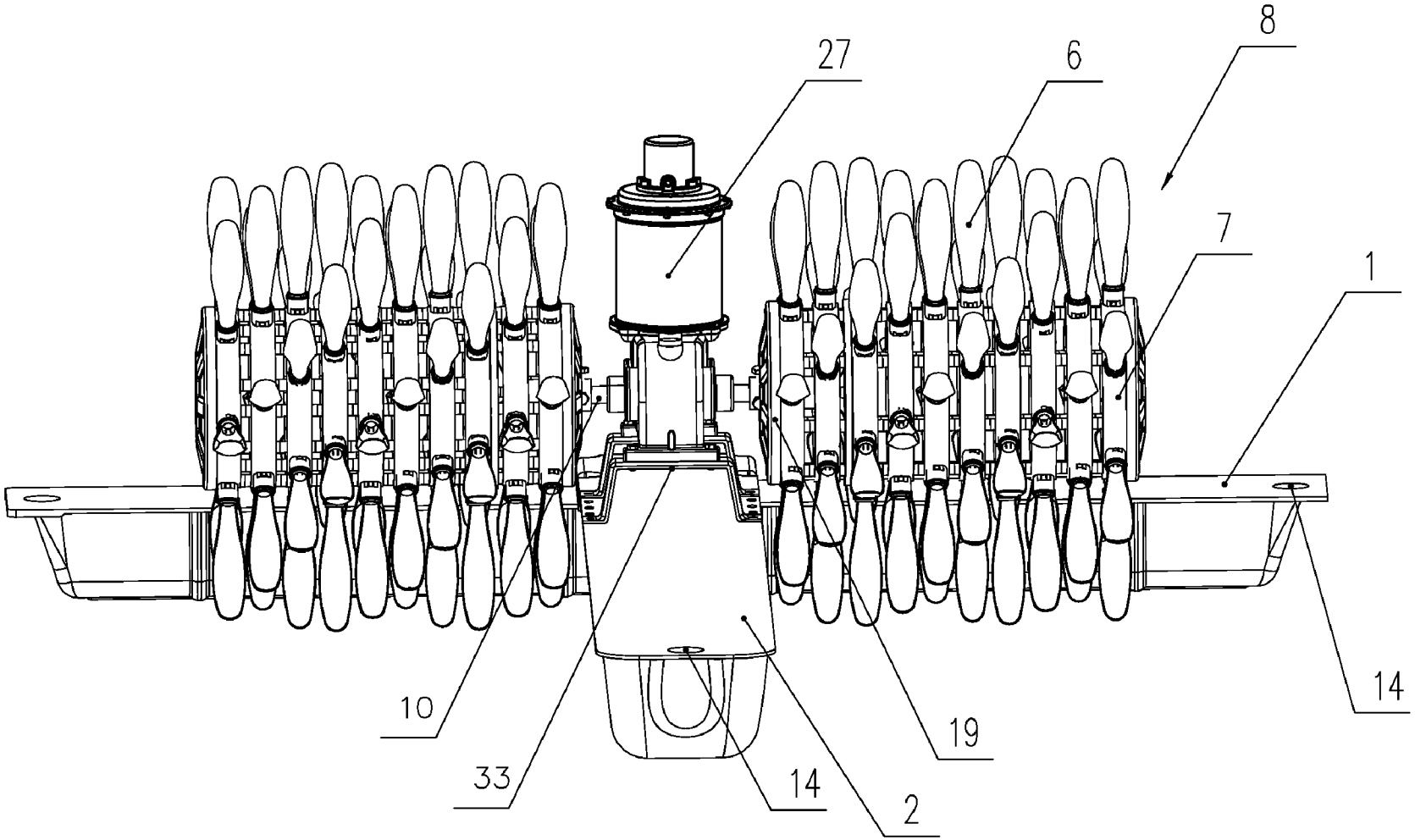
FIG. 2 is a structural schematic diagram for the combined waterwheel oxygen-increasing machine of another kind of "T" shaped floating bodies for the present invention.

Embodiment 2, as shown in FIG. 2, a combined water-wheel oxygen-increasing machine of another kind of "T" shaped floating bodies: a main longitudinal floating body (2) is vertically connected to the middle part of the transversal floating bodies (1) assembled by only one transversal segment floating body. On the main longitudinal floating body (2), a water-cooled engine (27) sets uprightly, below the water-cooled engine (27) a reduction gearbox is connected. On both the right and left sides of drive shaft (10) of said gearbox connect an overlapping impeller (8) respectively, which is formed firstly by several single impeller bodies (7) with a plural number of blades (6) connected in a series and then by an end cover (19) installed on both ends. The blades (6) of the overlapping impellers appear to be spiral shaped along the direction of the drive shaft (10), thus stressed pressure of impellers is more uniform while water is stirred. The splash raised by the blades (6) close to the power device (9) can be put on the water-cooled engine (27), thus achieving cooling purpose. On the end part of the transversal floating body (1) and main longitudinal floating body (2) set the rod-inserting hole for floating bodies location (14) which is used to put a location rod capable of inserting water bottom, for the prevention of the oxygen-increasing machine from moving in the water while it works.

Figure 3:
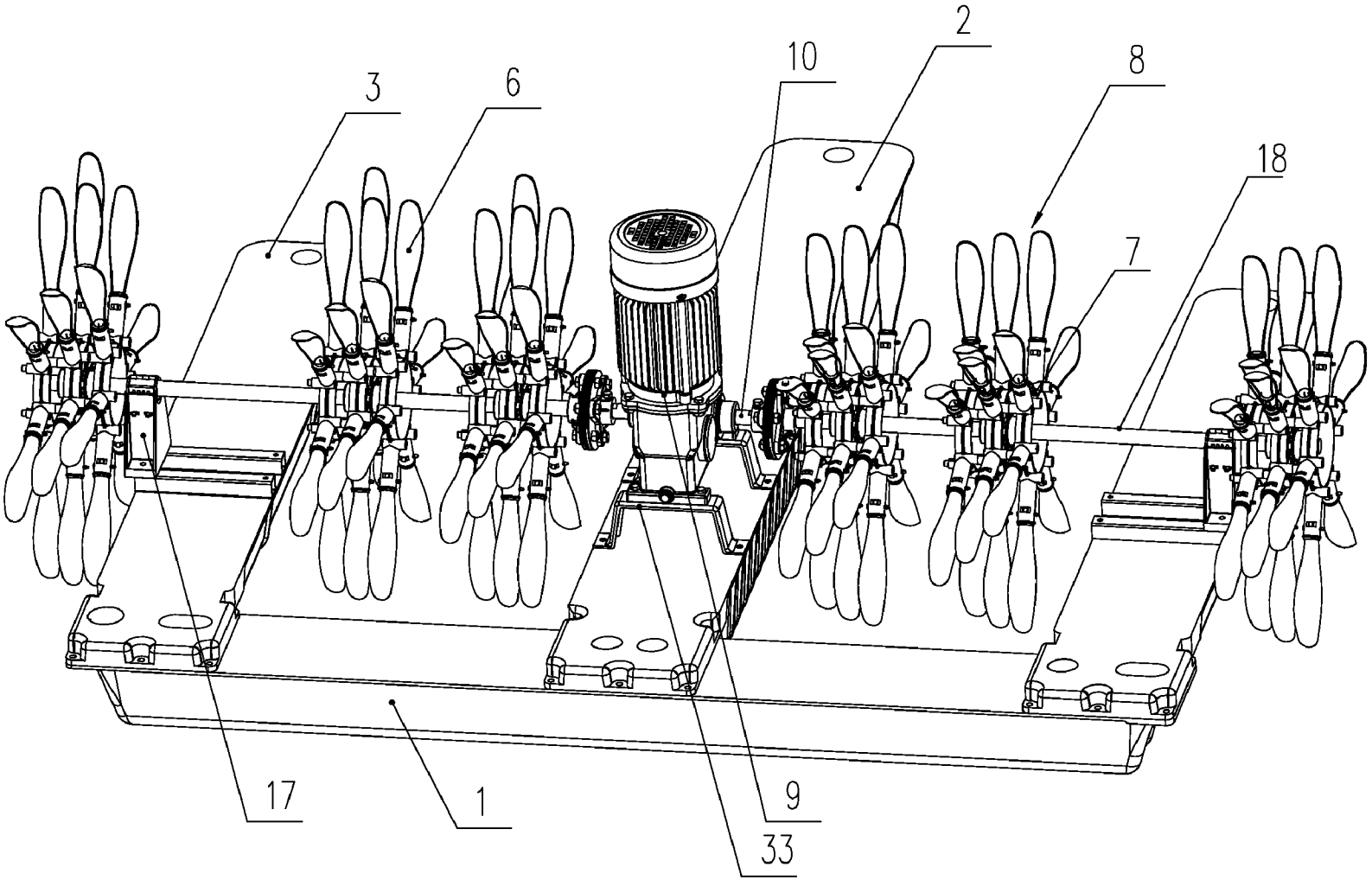
FIG. 3 is a structural schematic diagram for the combined waterwheel oxygen-increasing machine of "E" shaped floating bodies for the present invention.

Embodiment 3, as shown in FIG. 3, a combined water-wheel oxygen-increasing machine of "E" shaped floating bodies: in the middle part, one transversal floating body (1) assembled by only one transversal segment floating body vertically connects with the main longitudinal floating body (2) and on both sides respectively connects the auxiliary longitudinal floating bodies (3) same side with, and parallel to, the main longitudinal floating body (2). The power device (9) and reduction gearbox are set on the main longitudinal floating body (2) by a mounting bracket (33). The output shaft includes the reduction gearbox drive shaft (10) and propeller shaft (18) with both sides connected by a shaft coupler. The bearing seat (17) is set on the auxiliary longitudinal floating bodies (3). The other end of the propeller shaft (18) is set on to the bearing seat (17). Each overlapping impellers include three series of connected single impeller bodies (7). Between the main longitudinal floating body (2) and the auxiliary longitudinal body (3), two overlapping impellers are set symmetrically and connected to the propeller shaft (18). On the outer side of each auxiliary longitudinal floating body (3) sets an overlapping impeller in accordance to the actual demand.

Figure 4:
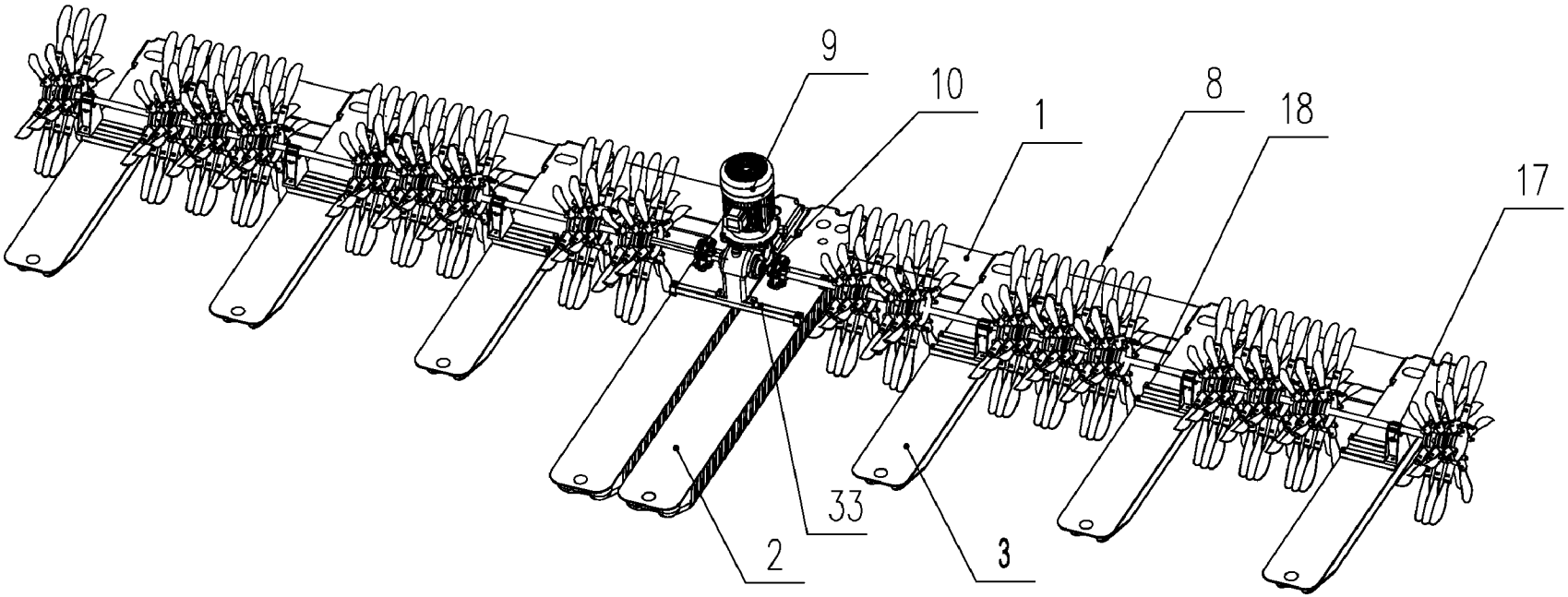
FIG. 4 is a structural schematic diagram for the combined waterwheel oxygen-increasing machine of comb-tooth shaped floating bodies for the present invention.

Embodiment 4, as shown in FIG. 4, a combined water-wheel oxygen-increasing machine of comb-tooth shaped floating bodies: the transversal floating body (1) is lengthened, which can be made by a long transversal segment floating body or by connecting a plurality of transversal segment floating bodies. Two main longitudinal floating bodies (2) are connected to the middle part of the transversal floating body (1). Several installing holes can be selected for the transversal floating body (1) and the longitudinal floating bodies. The power device (9) and reduction gearbox are set on the main longitudinal floating body (2) by a mounting bracket (33). The output shaft includes a reduction gearbox drive shaft (10) and a propeller shaft (18) with both sides connected through a shaft coupler. Three auxiliary longitudinal floating bodies (3) for each side are symmetrically connected on both the right and left sides of the main longitudinal floating body (2). The bearing seat (17) is set on each auxiliary longitudinal body (3). The overlapping impellers (8) are set on the propeller shaft (18) and placed between two neighboring longitudinal floating bodies. The propeller shaft (18) extends from the auxiliary floating bodies (3) utmost exterior of both sides of the floating bodies and one overlapping impeller (8) is connected to each one. Therefore, the comb-tooth structure can increase or decrease the number of floating bodies and impellers according to the actual situations, thus being flexible and convenient for application.

Figure 5:
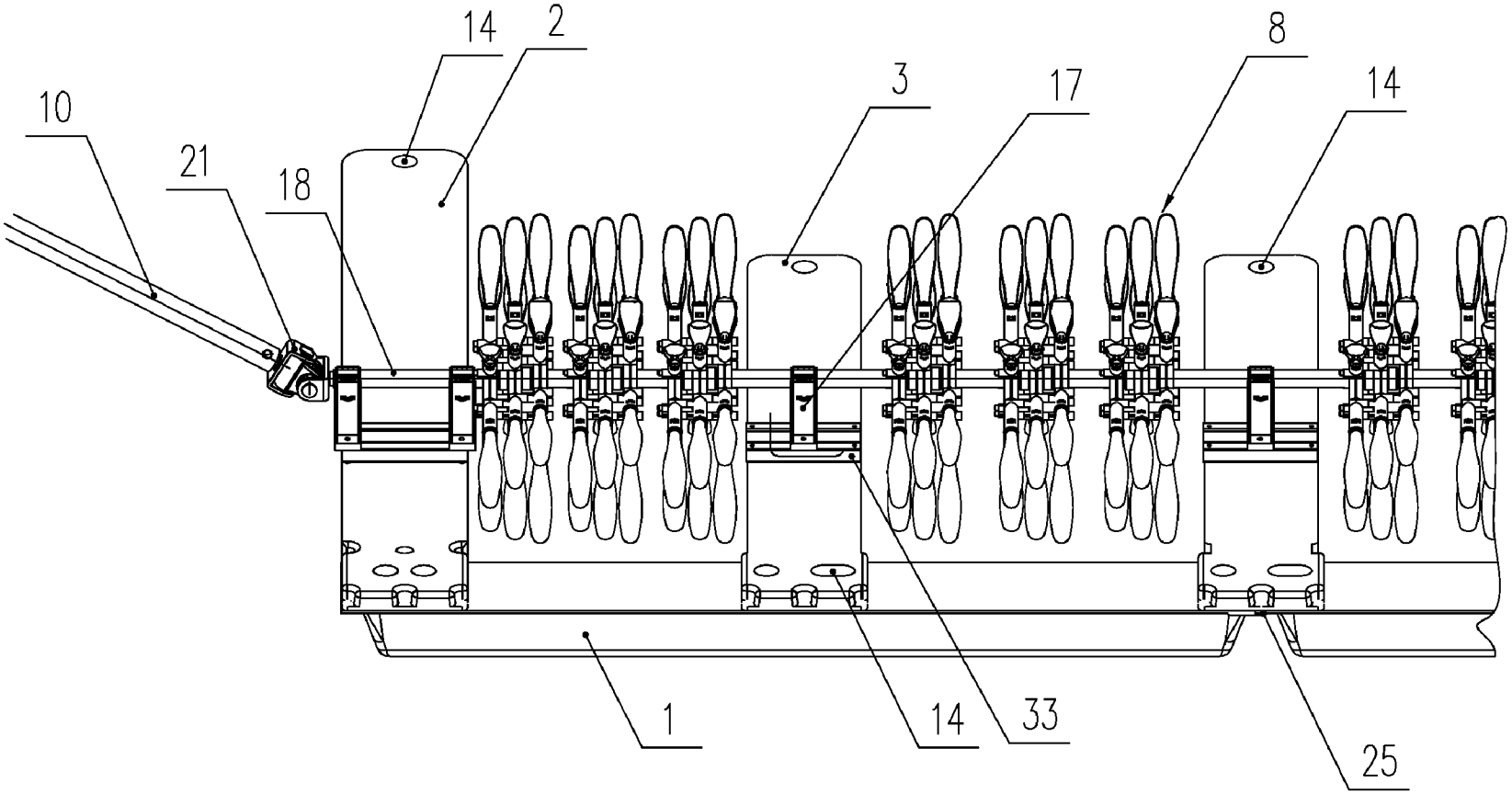
FIG. 5 is a partial structural schematic diagram for the combined waterwheel oxygen-increasing machine of another kind of comb-tooth shaped floating bodies for the present invention.

Embodiment 5, as shown in FIG. 5, a combined water-wheel oxygen-increasing machine of another kind of comb-tooth shaped floating bodies can be realized by lengthening the transversal floating body (1) via methods of choosing one long transversal segment floating body or a plurality of the transversal segment floating bodies connected mutually by contact surface (25). The main longitudinal floating body (2) connects to the transversal floating body on the end part. The plural numbers of auxiliary longitudinal floating bodies (3) are equidistantly connected to the rest of the parts. The power device (9) and reduction gearbox (not indicated in the figure) are set on one side of the combined floating bodies and on the coast of water area or on other bearing bodies. The output shaft includes a drive shaft (10) of reduction gearbox and a propeller shaft (18) with one side connected through a universal drive joint (21). The bearing seat (17) is set on to the auxiliary longitudinal floating bodies (3) by a mounting bracket (33). The propeller shaft (18) is set on the longitudinal floating bodies. The propeller shaft (18) between neighboring longitudinal floating bodies connects the same number of overlapping impellers (8). On the end part of the main longitudinal floating body (2) and the auxiliary floating bodies (3) sets the rod-inserting hole for floating bodies location (14). Since the power device is not set on to the combined floating bodies, an internal-combustion engine can be used to replace the engine, which makes it very applicable to areas without a power supply.

Figure 6:
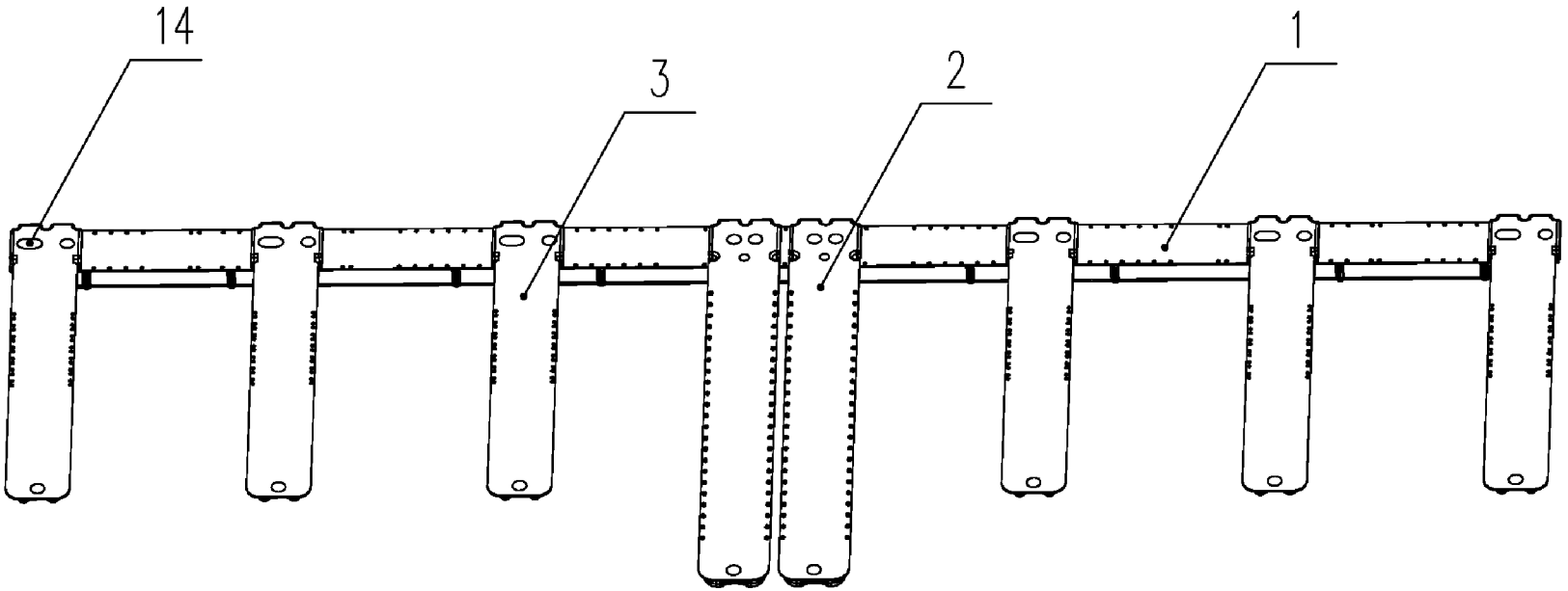
FIG. 6 is an assembly schematic diagram for the comb-tooth shaped floating bodies for the present invention.
Figure 7:
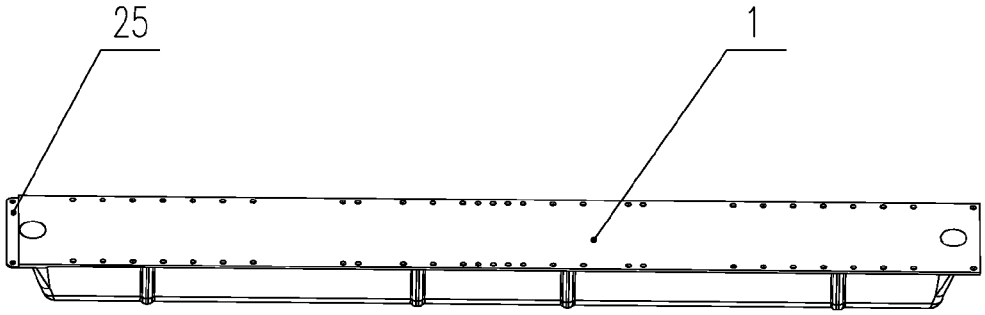
FIG. 7 is a structural schematic diagram for one transversal segment floating body for the present invention.
Figure 8:
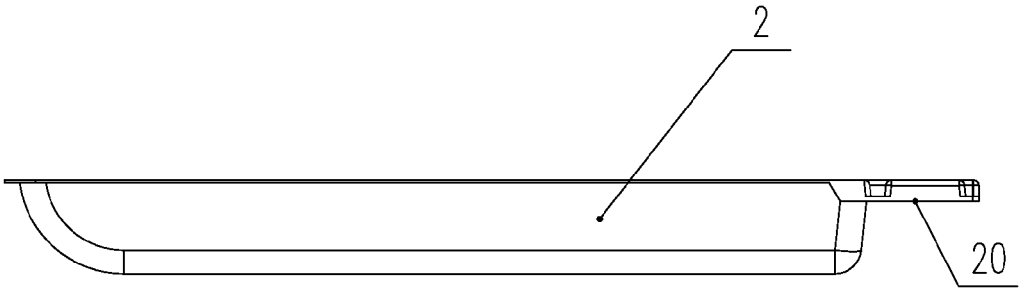
FIG. 8 is a structural schematic diagram for the main longitudinal floating body for the present invention.
Figure 9:
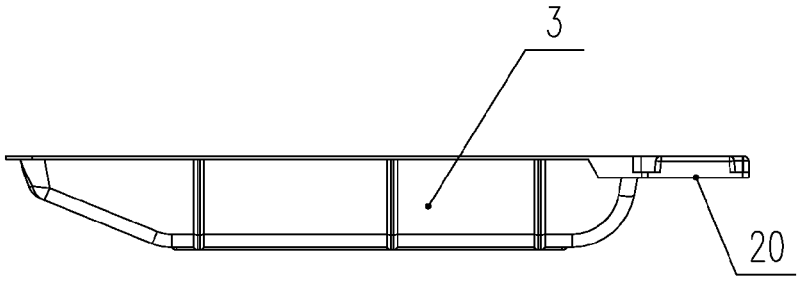
FIG. 9 is a structural schematic diagram for the auxiliary longitudinal floating body for the present invention.
Figure 10:
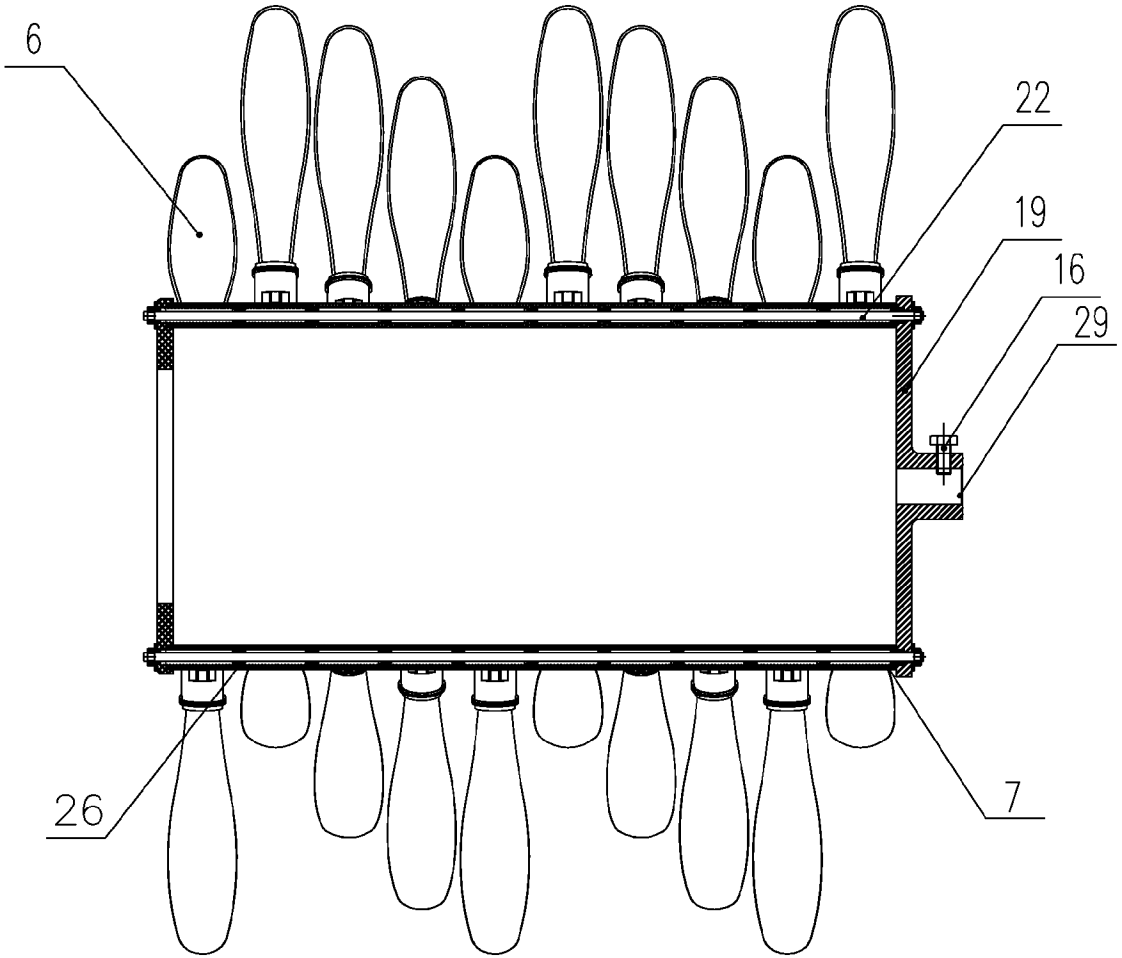
FIG. 10 is a sectional view for one kind of overlapping impellers for the present invention.
Figure 11:
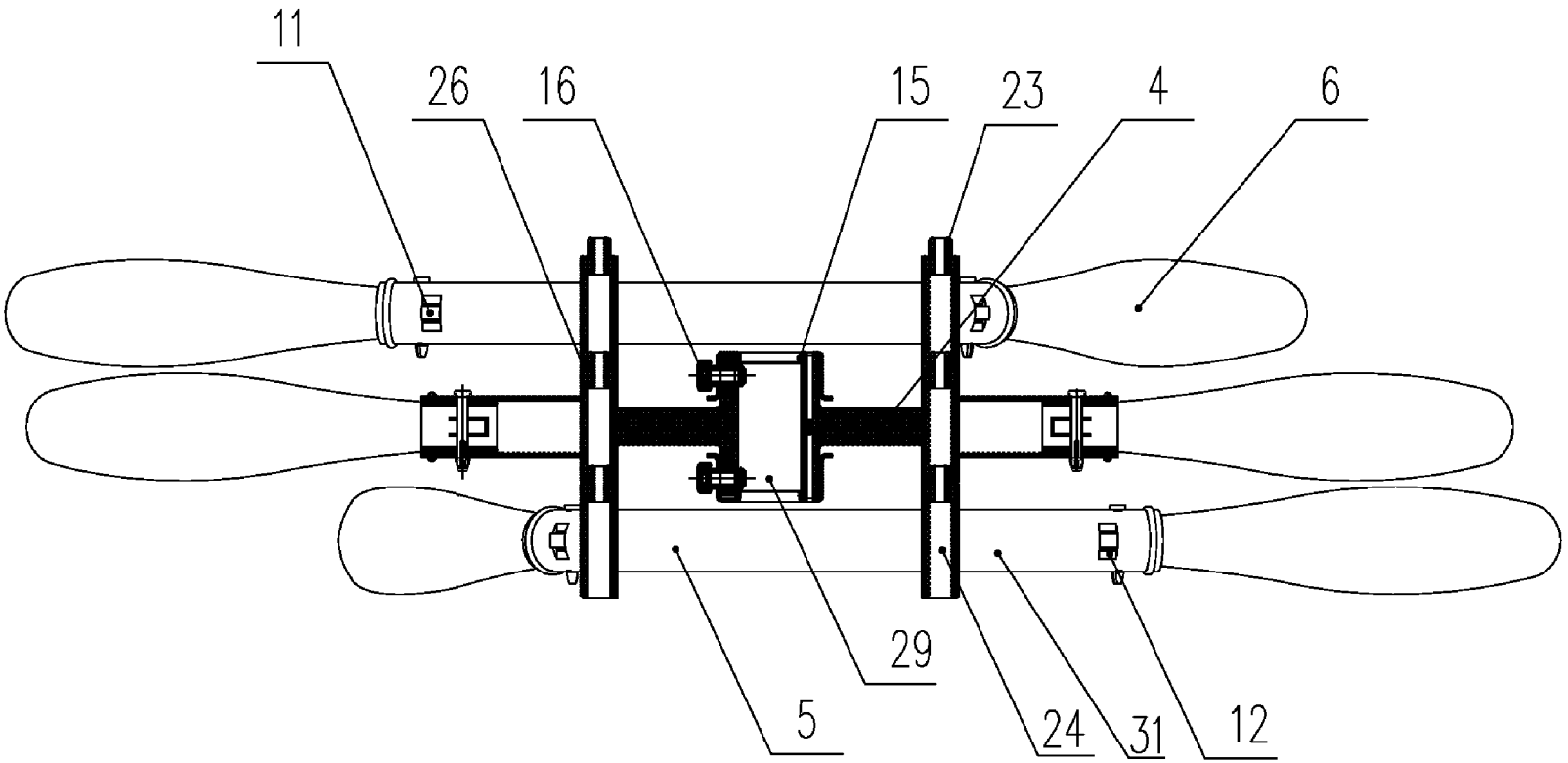
FIG. 11 is a sectional view for another kind of overlapping impellers for the present invention.
Figure 12:
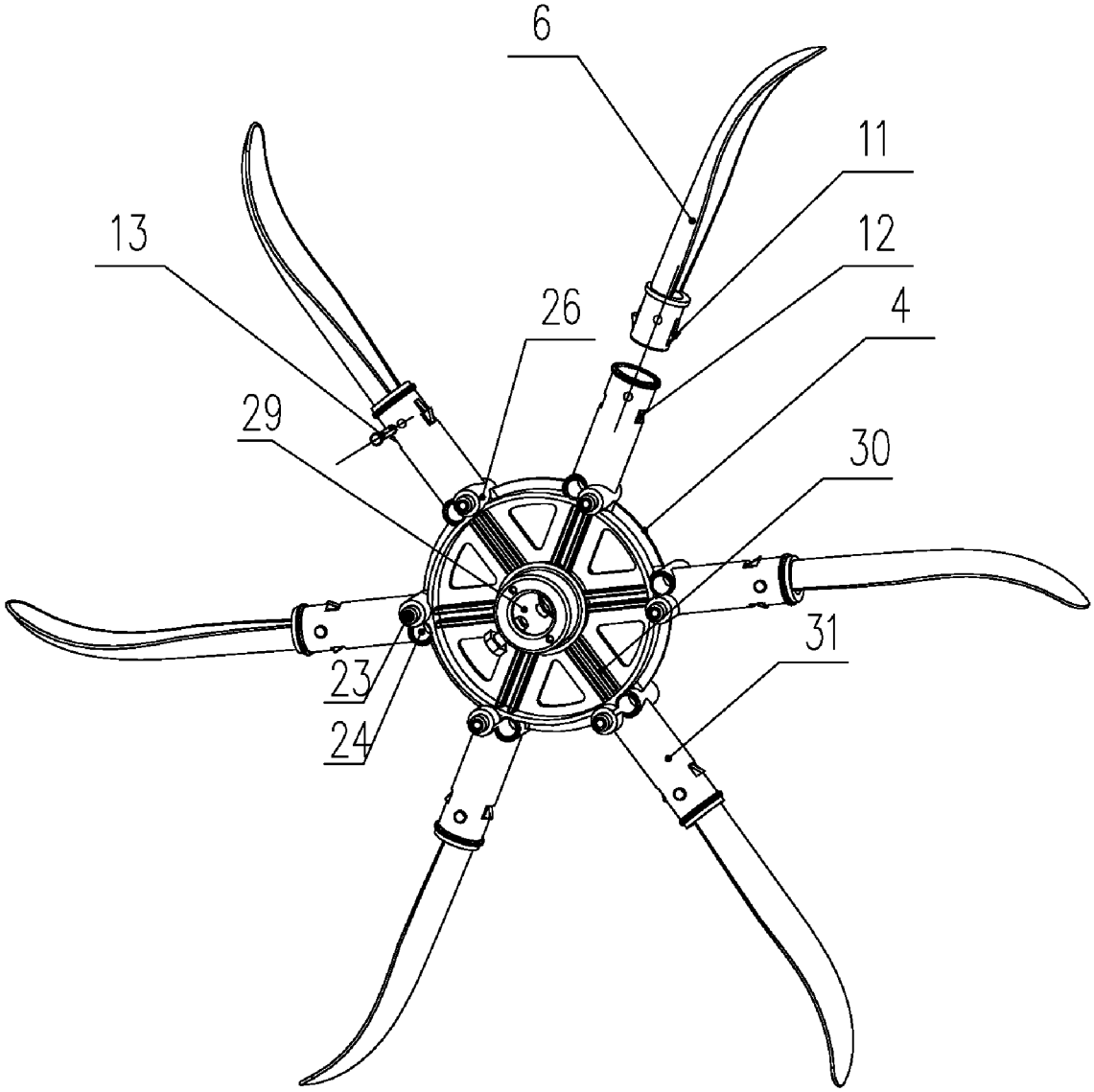
FIG. 12 is a structural schematic diagram for the single impeller body of the overlapping impellers having main impeller seats for the present invention.
Figure 13:
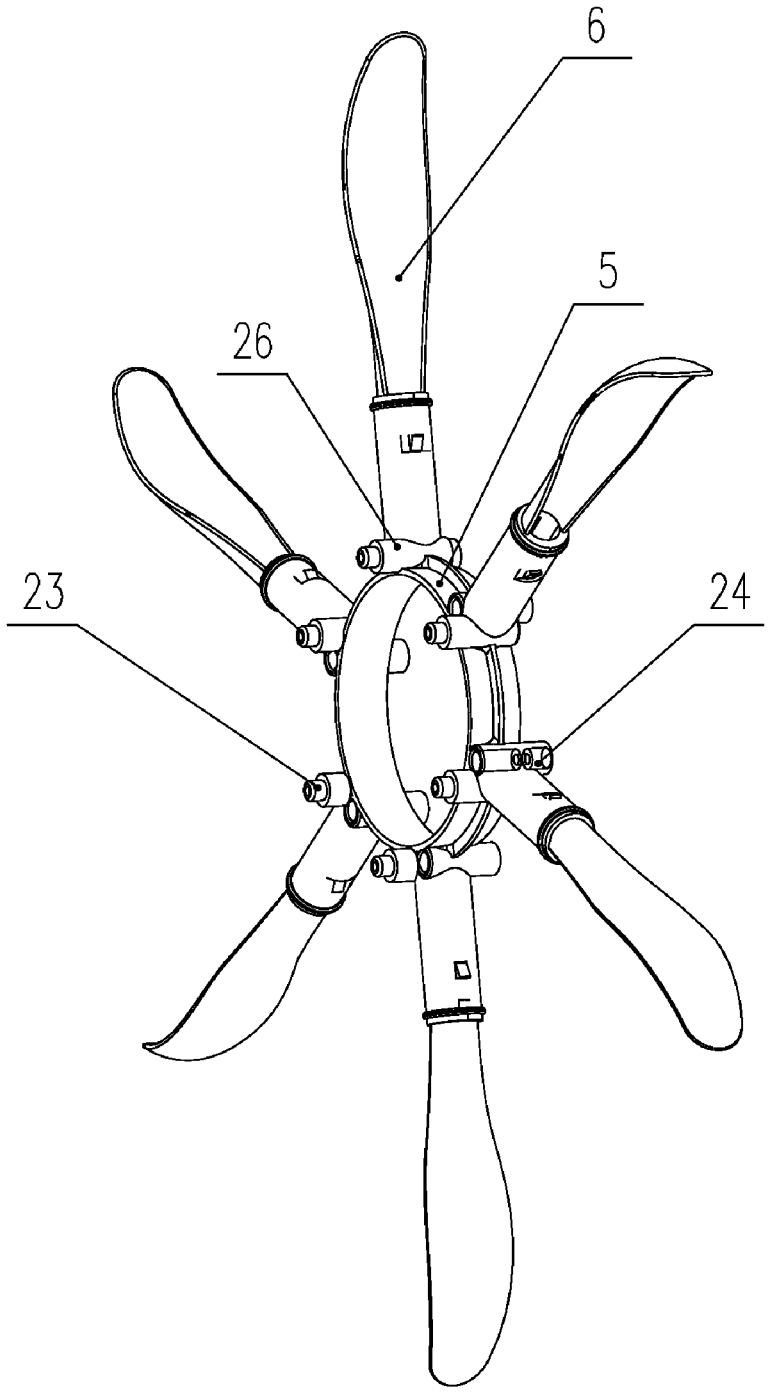
FIG. 13 is a structural schematic diagram for the single impeller body of the overlapping impellers having auxiliary impeller seats for the present invention.

The connection methods of combined floating bodies will be described hereinafter in combination with the figures:

As shown in FIG. 6, 7, 8, 9, on one end of the transversal body (1) sets a benched contact surface (25). While a plurality of transversal segment floating bodies are mutually connected for lengthening, the contact surface (25) of one transversal segment floating body overlaps with the end of another transversal segment floating body without a contact surface and then fastens by screws. On one end of the main longitudinal body (2) and the auxiliary longitudinal floating body (3) respectively sets a combined surface (20) connected with the transversal floating body. While the main longitudinal floating body (2) and auxiliary longitudinal floating body (3) are vertically connected to the transversal floating body (1), the combined surface (20) overlaps with the transversal floating body (1) and is then fastened. The auxiliary floating body (3) can be connected to the middle part of one transversal segment floating body (1) or the connecting part of two neighboring transversal segment floating bodies.

Figure 17:
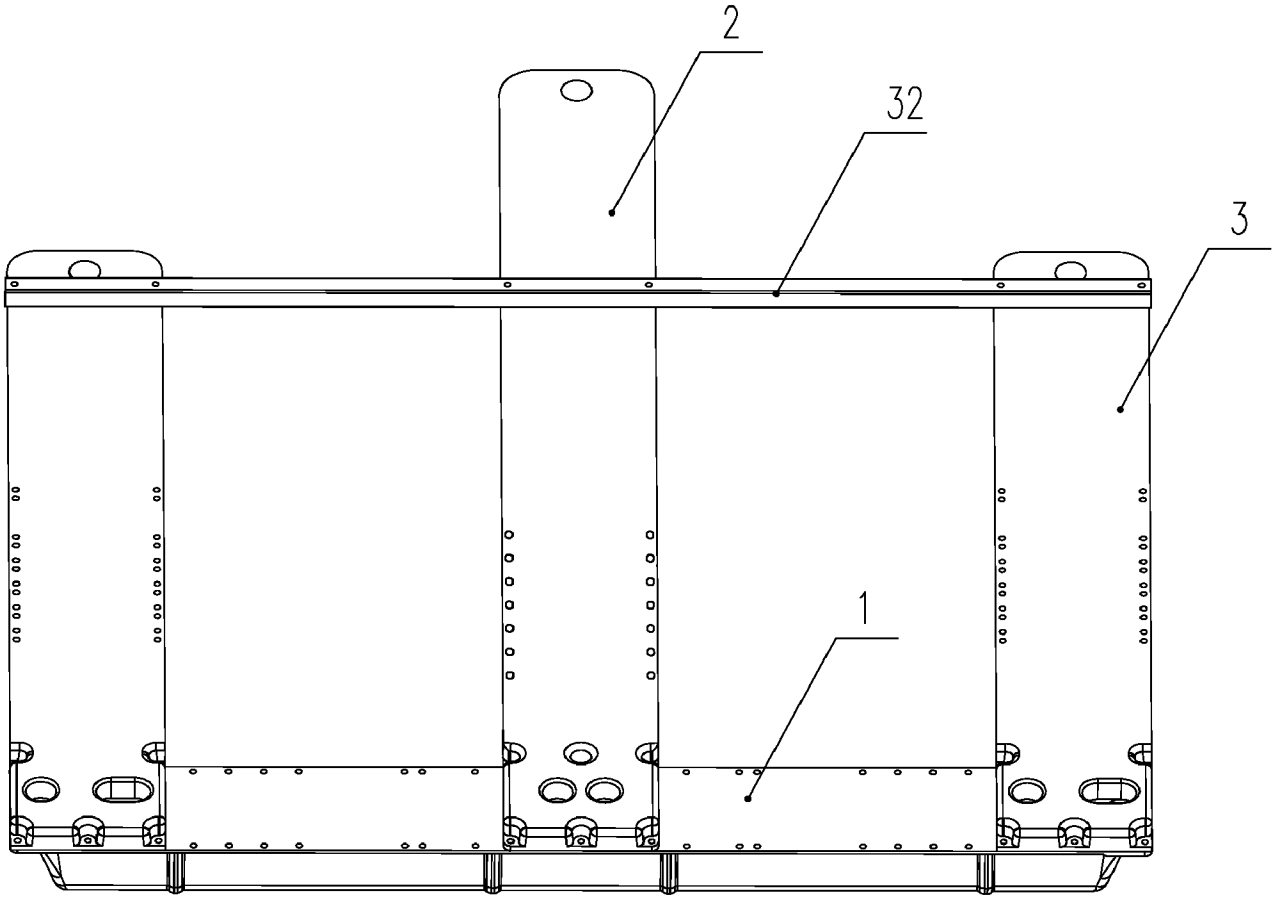
FIG. 17 is a structural schematic diagram for "E" shaped floating bodies assembled with rod for the present invention.
Figure 18:
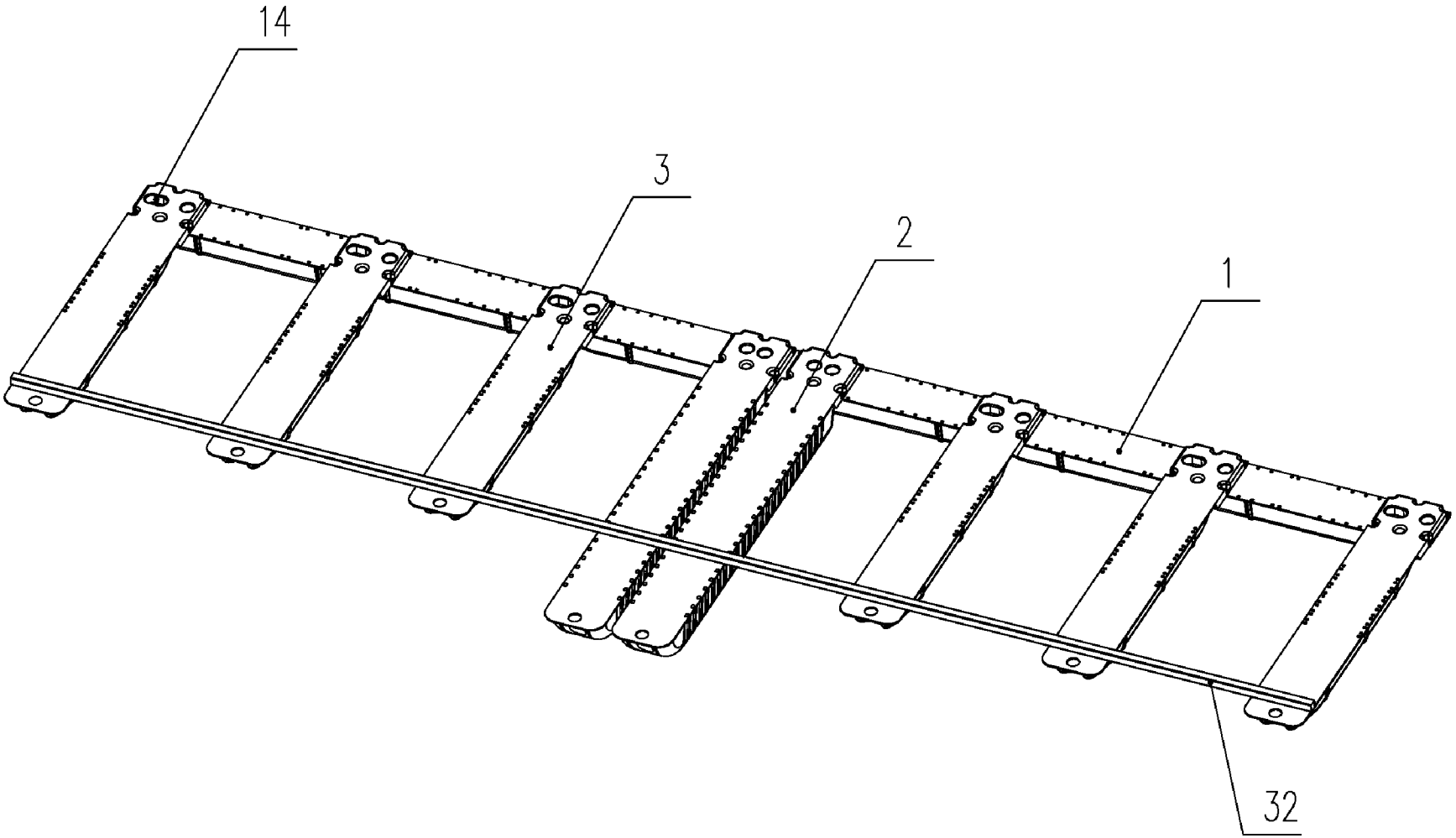
FIG. 18 is a structural schematic diagram for comb-tooth shaped floating bodies assembled with rod for the present invention.

As shown in FIG. 17, 18, in order to enhance the integrity and stability of the combined floating bodies (in particular, to enhance the integrity and stability of the floating bodies of the "E" shaped and comb-tooth shaped combined waterwheel oxygen-increasing machines), connection rod (32), which (32) is parallel to the transversal floating body (1), can be added to the free end of the longitudinal floating bodies.

The impellers with improved structure will be described hereinafter in combination with the figures:

As shown in FIG. 2, 10, the overlapping impellers in the Embodiment (2) comprise of a plural number of single impeller bodies (7), which (7) are composed of an impeller seat and blades (6) connected to it, wherein said blades (6) are evenly distributed on the impeller seat having a hollow structure. Hollow connection seats (26) set on the impeller seat evenly distributed on the wheel edge of the impeller seat and are used to connect the neighboring single impeller bodies. There is a through-hole inside of the connection seat (26) with one end being the end cover (19). In the center of the end cover (19) a boss shaft hole (29) is used in cooperation with the output shaft. On the wall of the shaft hole sets a recess with a radial-directed through-hole in which a nut is pre-embedded. The nut is connected with a bolt (16) used to tightly fit the output shaft. The long stud bolt (22) passes through the end cover (19) and all single impeller bodies (7) to connect them in a series to form overlapping impellers.

As shown in FIG. 3, 4, 11, 12, 13, the overlapping impellers in Embodiment (3) and (4) comprise of a plural number of single impeller bodies (7) which are composed of impeller seat and blades (6) connected to it, wherein said blades are evenly distributed on the impeller seat with a connection seat (26) for connecting the neighboring single impeller bodies set to it. The connection seat (26) is a hollow structure and evenly distributed on the exterior of the wheel edge of the impeller seat, wherein on one end sets a connection column (23) and on the other end sets a connection hole (24). The connection column (23) and the connection hole (24) are placed in disarrangements. The series connection of single impeller bodies can form spiral shaped impellers with blades disarranged by a 15° angle, making stressed pressure even during operation. On the connection seat sets a radial-directed plug seat (31) in which a location notch (12) is slotted. The elastic fixing block (11) is set on to the connection end of blades. The connection end is plugged in to the plug seat (31). The elastic fixing block (11) is clamp-connected in to the location notch (12) and localized by a plug (13). The impeller seat divide into the main impeller seat (4) and auxiliary impeller seat (5), wherein the main impeller seat is provided with a boss-shaped shaft hole (29), which (29) is covered by a reinforcing sleeve (15) made by stretching metal. This achieves a better application effect. There is a recess within the radial-directed through-hole on the wall of the boss-shaped shaft hole. A nut is pre-embedded in the recess. The nut is twist-connected with a bolt (16). The acting force of the bolt (16) exerted on to the shaft is borne by the reinforcing sleeve (15). The shaft hole and wheel edge are connected by a bearing bar (30). The main impeller seat and auxiliary impeller seat are connected in a series by the connection seat (26). The connection seat can be bolt connected and fastened by bolts and nuts.

Figure 14:
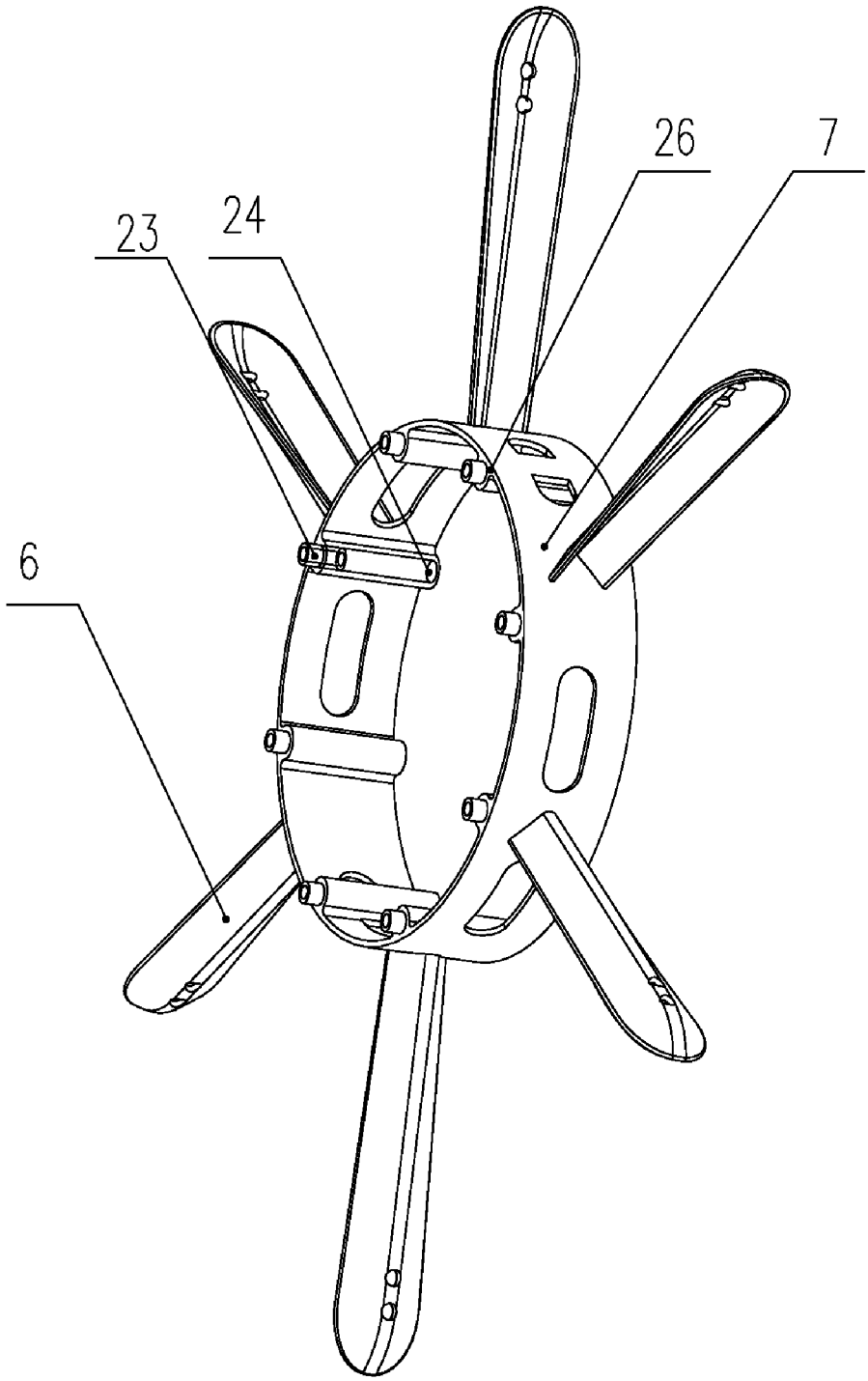
FIG. 14 is a structural schematic diagram for one single impeller structure body of the overlapping impellers for the present invention.

As shown in FIG. 14, the overlapping impellers for the present invention can be structured like this: a plural number of hollow connection seats (26) are evenly distributed on the internal edge of the impeller seat of the single impeller body (7), wherein one end of the connection seat is the connection column (23) and the other end is the connection hole (24). The blades (6) are integrally formed on to the impeller seat, wherein the blades have a water-passing hole. A plural number of such single impeller bodies (7) can form overlapping impellers by connecting long stud bolts (22) in a series.

Figure 15:
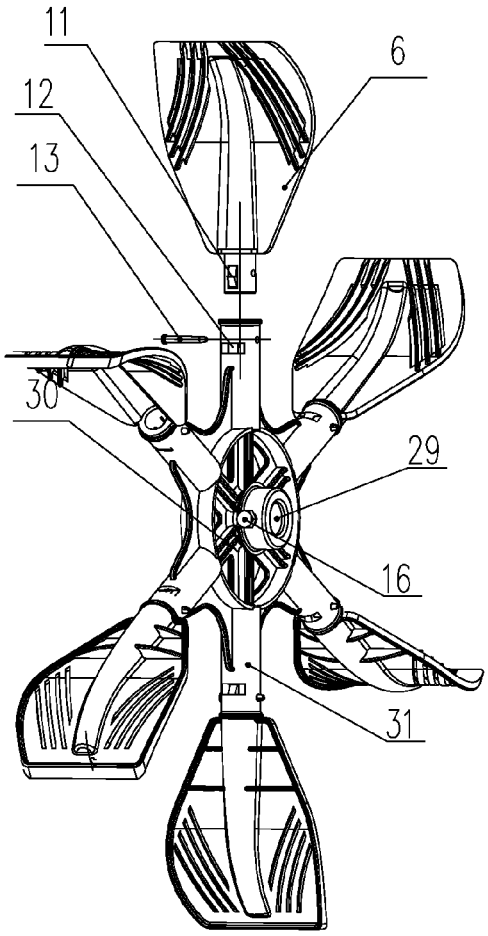
FIG. 15 is a structural schematic diagram for one kind of impellers for the present invention.

As shown in FIG. 15, the impellers for the present invention can be structured like this: in the center of the impeller seat sets a boss-shaped shaft hole (29). On the outer edge of the shaft hole sets a recess with a radial-directed through-hole, in which a nut is pre-embedded. The nut is with a bolt (16). The shaft hole and wheel edge are connected by a bearing bar (30). On the outer side of the impeller seat sets plug seats (31) distributed evenly, which have a location notch (12). The elastic fixing block (11) is set on the connection end of the blades (6). The connection end is plugged into the plug seat (31). The elastic fixing block (11) is clamp-connected into the location notch (12) and further localized by a plug (13). The blades (6) have several guiding gutters in order to reduce resistance; this kind of impeller can be solely connected to the drive shaft (10) or the propeller shaft (18) for operation.

Figure 16:
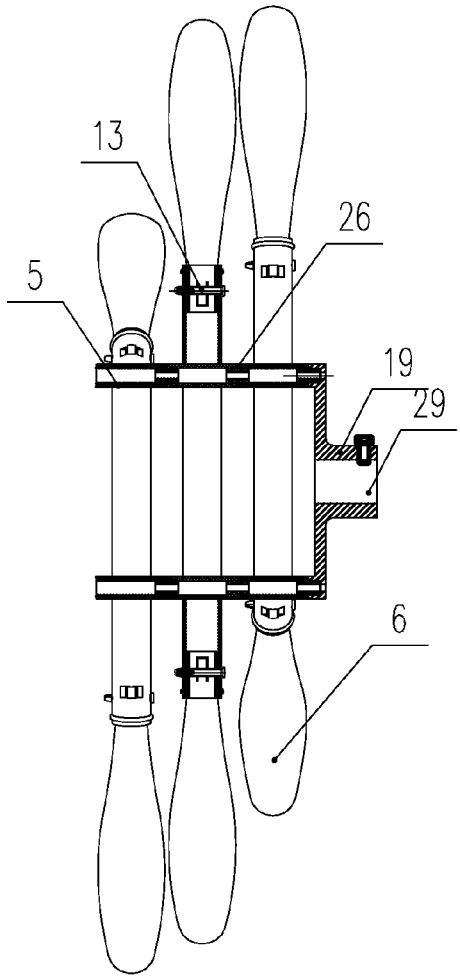
FIG. 16 is a sectional view for another kind of the overlapping impellers for the present invention.

As shown in FIG. 16, the overlapping impellers for the present invention also can be structured like this: a plural number of auxiliary impeller seats (5) plugged by blades (6) are firstly mutually connected in a series through the connection seats (26) and then connected with the end cover (19) on one end, assembled to form overlapping impellers connected with the drive shaft (10) or propeller shaft (18) for application.

A plurality of single impeller bodies are overlapped into impellers. While overlapping, many methods such as thread, stud bolt, gluing, welding, bayonet, etc., can be adopted in order to achieve the result. The blades (6) can be made into different shapes, such as angular shapes, curved shapes, flat plated shapes, etc., and in structure with holes or a reinforcing rib, etc.

The vertical connection of the transversal floating body and the longitudinal floating bodies for the present invention includes but is not restricted to the 90° connection, i.e. A connection with a certain deflected angle between them is also be accepted. For example, the transversal floating body and the longitudinal one are connected at an included angle of 85°.

The embodiments mentioned above include the improved solutions to floating bodies and impellers. All identical structures developed from these improved solutions also belong to the scope of the present invention.

What is claimed is:

1. A combined waterwheel oxygen-increasing machine, comprising a combined floating body, a power device (9), a reduction gearbox and impellers (8), the power device (9) is connected to the reduction gearbox for driving the impellers via an output shaft, the combined floating body includes a transversal floating body (1) assembled by one transversal segment floating body at least and longitudinal floating bodies, which is connected vertically with the longitudinal floating bodies, one end of each longitudinal floating body is connected to the transversal floating body (1), the part of the combined floating body for bearing the output shaft and the impellers (8) are surrounded by the longitudinal floating bodies and the transversal floating body (1).

2. The combined waterwheel oxygen-increasing machine according to claim 1, wherein the longitudinal floating body is vertically connected to the center part of the transversal floating body (1) to form a "T" shape of the combined floating body, the power device (9) and reduction gearbox are set on the longitudinal floating body, the impellers are installed on an output shaft and symmetrically arranged on both sides of the longitudinal floating body.

3. The combined waterwheel oxygen-increasing machine according to claim 1, wherein the two ends and middle part of said transversal floating body (1) are connected by the parallel longitudinal floating bodies with same side to the transversal body to form an "E" shaped combined floating body, the power device (9) is installed on the longitudinal floating body in the middle, the output shaft includes a drive shaft of the reduction gearbox (10) and a propeller shaft (18) connected with the drive shaft (10), the impellers (8) are set on to the propeller shaft (18).

4. The combined waterwheel oxygen-increasing machine according to claim 1, wherein plural longitudinal floating bodies are connected with the combined transversal floating body (1) in balance to form comb-tooth shaped floating bodies, the output shaft includes a drive shaft of reduction gearbox (10) and a propeller shaft (18) connected with the drive shaft, and said impellers (8) are set on the propeller shaft (18).

5. The combined waterwheel oxygen-increasing machine according to claim 4, wherein said impellers are set between longitudinal floating bodies which include main longitudinal floating bodies (2) and auxiliary longitudinal floating bodies (3), the power device (9) and reduction gearbox are set on one side of the floating bodies, the drive shaft of reduction gearbox (10) drives the propeller shaft (18) through a universal drive joint (21), the impellers (8) are set on the propeller shaft (18), which (18) is borne on a bearing seat (17).

6. The combined waterwheel oxygen-increasing machine according to claim 3, wherein the impellers are set between longitudinal floating bodies which include main longitudinal floating bodies (2) and auxiliary longitudinal floating bodies (3), the main longitudinal floating body (2) is equipped with the power device (9), the auxiliary longitudinal floating bodies (3) are equipped with bearing seats (17) and the propeller shaft (18) is borne on the bearing seats (17).

7. The combined waterwheel oxygen-increasing machine according to claim 4, wherein the impellers are set between longitudinal floating bodies which include main longitudinal floating bodies (2) and auxiliary longitudinal floating bodies (3), the main longitudinal floating body (2) is equipped with said power device, the auxiliary longitudinal floating bodies (3) are equipped with bearing seats (17) and the propeller shaft (18) is borne on the bearing seats (17).

8. The combined waterwheel oxygen-increasing machine according to claim 3, wherein a connection rod (32) paralleled to the transversal floating body is set on the free end of the longitudinal floating bodies, a flange with a through-hole is set on the side part of the longitudinal floating bodies and a fastener passing the through-hole fixes a mounting bracket (33) on to the floating bodies.

9. The combined waterwheel oxygen-increasing machine according to claim 4, wherein a connection rod (32) paralleled to the transversal floating bodies is set on the free end of the longitudinal floating bodies, a flange with a through-hole is set on the side part of the longitudinal floating bodies and a fastener passing the through-hole fixes a mounting bracket (33) on to the floating bodies.

10. The combined waterwheel oxygen-increasing machine according to claim 2, wherein the impellers (8) are overlapping impellers composed of a plurality of single impeller bodies connected in a series, the single impeller body (7) composed of an impeller seat and blades (6) connected on the seat, a link mechanism connecting neighboring single impeller bodies is set on the impeller seat.

11. The combined waterwheel oxygen-increasing machine according to claim 3, wherein the impellers (8) are overlapping impellers composed of a plurality of single impeller bodies connected in a series, the single impeller body (7) composed of an impeller seat and blades (6) connected on the seat, a link mechanism connecting neighboring single impeller bodies is set on the impeller seat.

12. The combined waterwheel oxygen-increasing machine according to claim 4, wherein said impellers (8) are overlapping impellers composed of a plurality of single impeller bodies connected in a series, the single impeller body (7) composed of an impeller seat and blades (6) connected on the seat, a link mechanism connecting neighboring single impeller bodies is set on the impeller seat.

13. The combined waterwheel oxygen-increasing machine according to claim 10, wherein the link mechanism is a connection seat (26) distributed on the wheel edge of the impeller seat, a connection rod (23) is set on to one end of the connection seat and a connection hole (24) is on the other end.

14. The combined waterwheel oxygen-increasing machine according to claim 11, wherein the link mechanism is a connection seat (26) distributed on the wheel edge of the impellers seat, a connection rod (23) is set on to one end of the connection seat and a connection hole (24) is on the other end.

15. The combined waterwheel oxygen-increasing machine according to claim 12, wherein the link mechanism is a connection seat (26) distributed on the wheel edge of the impellers seat, a connection rod (23) is set on to one end of the connection seat and a connection hole (24) is on the other end.

16. The combined waterwheel oxygen-increasing machine according to claim 10, wherein the link mechanism can be an internal and external thread set separately on both sides of the wheel edge.

17. The combined waterwheel oxygen-increasing machine according to claim 11, wherein the link mechanism can be an internal and external thread set separately on both sides of the wheel edge.

18. The combined waterwheel oxygen-increasing machine according to claim 12, wherein the link mechanism can be an internal and external thread set separately on both sides of the wheel edge.

* * * * *